US009476683B2

(12) United States Patent
Marchais et al.

(10) Patent No.: US 9,476,683 B2
(45) Date of Patent: Oct. 25, 2016

(54) MUNITION, CHARGE FOR SUCH A MUNITION, AND METHOD OF MANUFACTURING SUCH A MUNITION

(71) Applicant: EURENCO, Paris (FR)

(72) Inventors: Marie Marchais, Paris (FR); Olivier Bouchet, Jonquerettes (FR); Bruno Nouguez, Villejuif (FR)

(73) Assignee: EURENCO, Paris (FR)

( * ) Notice: Subject to any disclaimer, the term of this patent is extended or adjusted under 35 U.S.C. 154(b) by 0 days.

(21) Appl. No.: 14/365,727

(22) PCT Filed: Dec. 14, 2012

(86) PCT No.: PCT/FR2012/052941

§ 371 (c)(1),
(2) Date: Jun. 16, 2014

(87) PCT Pub. No.: WO2013/088090

PCT Pub. Date: Jun. 20, 2013

(65) Prior Publication Data

US 2014/0331882 A1 Nov. 13, 2014

(30) Foreign Application Priority Data

Dec. 14, 2011 (FR) ..... 11 61638

(51) Int. Cl.
*F42B 12/20* (2006.01)
*F42B 25/00* (2006.01)
(Continued)

(52) U.S. Cl.
CPC ..... *F42B 25/00* (2013.01); *F42C 19/0807* (2013.01); *F42C 99/00* (2013.01)

(58) Field of Classification Search
CPC ..... F42B 1/00; F42B 8/16; F42B 8/22; F42B 12/207; F42B 25/00; F42C 19/0807; F42C 19/0838; F42C 19/0842; F42C 19/0846; F42C 99/00
USPC ..... 102/396
See application file for complete search history.

(56) References Cited

U.S. PATENT DOCUMENTS 1,556,027 A * 10/1925 Ragsdale ..... F42C 15/20 102/396
2,410,932 A * 11/1946 Ferrel ..... F42C 19/0846 102/225

(Continued)

FOREIGN PATENT DOCUMENTS

CA 2 066 139 A1 10/1992
DE 3541399 A1 * 5/1987 ..... F42B 8/14

(Continued)

OTHER PUBLICATIONS

International Search Report issued in International Patent Application No. PCT/FR2012/052941 dated Feb. 8, 2013 (with translation).

(Continued)

*Primary Examiner* — Gabriel Klein
(74) *Attorney, Agent, or Firm* — Oliff PLC

(57) ABSTRACT

The invention provides a filler material for a munition, inluding an explosive charge, an inert charge and at least one pyrotechnic transmission unit adapted to transmit a remotely initiated detonation to said explosive charge. The invention also concerns a munition incorporating said filler material, said munition including a hollow elongate casing suitable for housing the explosive charge and the inert charge, and a firing device, at least a portion of the inert charge being interposed between the firing device and said explosive charge, and the pyrotechnic transmission unit being provided with a pyrotechnic extension and coupling the firing device to the explosive charge in order to prime detonation of the explosive charge under the action of the firing device.

21 Claims, 5 Drawing Sheets

(51) Int. Cl.
*F42C 19/08* (2006.01)
*F42C 99/00* (2006.01)

(56) References Cited

U.S. PATENT DOCUMENTS

| | | | | | |
|---|---|---|---|---|---|
| 3,648,610 | A * | 3/1972 | van Zyl | F42B 12/32 | 102/389 |
| 3,786,714 | A * | 1/1974 | Dereich | F42B 12/80 | 86/23 |
| 4,615,272 | A * | 10/1986 | Aubert | F42B 12/80 | 102/331 |
| 6,283,036 | B1 * | 9/2001 | Munsinger | 102/479 | |
| 7,644,663 | B2 * | 1/2010 | Illesi | F42B 8/16 | 102/498 |
| 2002/0056395 | A1 * | 5/2002 | Gatti | F42B 8/22 | 102/395 |
| 2010/0263566 | A1 * | 10/2010 | Ruhlman | F42B 1/028 | 102/499 |

FOREIGN PATENT DOCUMENTS

| | | | | |
|---|---|---|---|---|
| DE | 421184 | B3 | 4/2010 | |
| EP | 2 048 470 | A2 | 4/2008 | |
| FR | 3002626 | A1 * | 8/2014 | F42B 12/207 |
| GB | 2453659 | A * | 4/2009 | F42B 25/00 |
| IT | 2863165 | A1 * | 4/2015 | F42B 8/16 |
| WO | WO 2008/118235 | A2 | 10/2008 | |

OTHER PUBLICATIONS

Written Opinion issued in International Patent Application No. PCT/FR2012/052941 dated Feb. 8, 2013.

* cited by examiner

MUNITION, CHARGE FOR SUCH A MUNITION, AND METHOD OF MANUFACTURING SUCH A MUNITION

The present invention relates to a munition, in particular a bomb and more particularly an aerial bomb, of the type comprising an elongate body housing an explosive charge and an inert charge, and a firing device. The present invention also relates to a filler material suitable for such a munition and to a method of manufacturing a munition of this type.

A munition of the above type is generally intended to be connected to a delivery platform, in particular an aircraft. The moment of inertia, the aerodynamics and the volumes of a munition of this type are dimensioned so as to comply with very precise specifications.

Integrating a munition into a delivery platform is extremely complex and expensive, and so it is important that improvements to it modify its aerodynamic and ballistic characteristics and also its architecture as little as possible compared with normal munitions.

Aerial weapons are currently principally used to reach targets on the ground such as bunkers, armored vehicles, etc. with precision.

When those targets are positioned in an urban environment, it is desirable to limit possible collateral damage by the munitions by orienting the air blast together with the shrapnel caused by their detonation in the direction of the envisaged targets.

One solution for reducing collateral damage of that type is to reduce the total mass of the explosive contained in the munition. Thus, munitions have been developed in the past in which an inert material inside the munition replaces part of the explosive. The inert material used generally has a density close to that of the explosive. Patent application WO 2008/118235 in particular describes a reduced collateral damage munition in which the inner wall of the casing is lined with an inert material that compensates for the mass, and the explosive charge occupies the remaining volume of the casing of the munition, while being in contact with the firing device.

That configuration cannot be used to reduce the collateral damage of the munition in a satisfactory manner. Furthermore, it also necessitates lining the inner wall of the casing of the munition with the inert material, before introducing the explosive charge. Hence, the method of manufacturing that munition is complex and expensive.

Thus, the skilled person is constantly searching for a munition, in particular an aerial munition, that can effectively reduce collateral damage, that is easy to manufacture, and that nevertheless preserves the principal architectural, mass, and ballistic characteristics of known munitions.

The aim of the present invention is to provide a novel munition that satisfies these conditions.

This aim is achieved by means of a munition of the type described, in which the inert charge is interposed between the firing device and said explosive charge, and which further comprises at least one pyrotechnic transmission unit provided with a pyrotechnic extension, said pyrotechnic transmission unit coupling the explosive charge to the firing device to allow said explosive charge to be detonated by the action of the firing device.

In the present application, the term "pyrotechnic transmission unit" means any element that is capable of propagating a detonation initiated by the firing device up to the explosive charge, even if it is positioned at a distance from said firing device.

Furthermore, the term "pyrotechnic extension" means any element that is capable of transmitting a detonation wave initially issuing from the firing device, without modifying said detonation wave, and in particular its surface amplitude, its intensity (or its power), or its shape.

In general, a pyrotechnic extension is an elongate element, i.e. longer than it is wide, that is rigid or flexible, and that has a substantially constant section.

Preferably, the pyrotechnic extension comprises an explosive compound of homogeneous composition, which is identical to or different from that of the explosive charge. More preferably, the pyrotechnic extension comprises a single explosive compound of homogeneous composition, in particular a monolithic explosive compound. Still more preferably, the pyrotechnic transmission unit comprises a single, preferably monolithic, explosive compound of homogeneous composition.

Preferably, the pyrotechnic extension has a maximum radial dimension that is substantially smaller than the maximum diameter of the munition, preferably at least 5 times smaller than that diameter, and still more preferably at least 20 times smaller than that diameter.

As indicated above, the aim of the present invention is to provide a munition that can effectively reduce collateral damage without modifying the architectural, mass, and ballistic characteristics of known munitions. In accordance with the invention, a munition of this type is obtained by reducing the volume of the explosive charge contained in a munition of conventional configuration and by positioning said explosive charge in the region of the munition that is the most appropriate, in particular at its front end, while keeping the firing device at the rear of the munition, the inert charge being positioned between the explosive charge and the firing device.

Since it includes the same elements as a standard munition (explosive charge, inert charge, firing device), which are simply arranged in a different manner, the munition of the invention has the same mass, the same center of gravity and the same moments of inertia as a standard munition, guaranteeing complete interchangeability (it can be connected to the same supports, compatibility with known kits and guidance systems, etc.).

The invention means that the power of the munition can be "tailored" at will by its construction, while retaining a standard, interchangeable size.

Since the aim is to limit the volume of explosive material inside the munition, it should be understood that the pyrotechnic transmission unit preferably has the smallest possible volume.

In particular, the pyrotechnic extension that forms the longest portion of the pyrotechnic transmission unit has a volume and thus a radial dimension or width that is as small as possible.

Preferably, the pyrotechnic extension is longer than it is wide, in particular at least 10 times longer than it is wide, preferably at least 20 times longer than it is wide.

In an advantageous arrangement, the length of the pyrotechnic extension is at least ½, preferably at least ⅔, the total length of the munition.

As indicated above, in an advantageous aspect of the present invention, the firing device is positioned at the rear end of the munition and the explosive charge is positioned at its front end.

In the present application, the term "front end" of the munition is used to denote that end faces in the direction said munition moves, and the term "rear end" denotes the opposite end in the axial direction.

Because the explosive charge is positioned at the front of the munition, the air blast and shrapnel resulting from the detonation are preferentially directed forwards, i.e. towards the target, and collateral damage towards the rear of the munition is considerably reduced.

In an advantageous embodiment, the pyrotechnic transmission unit further comprises a first booster coupling said pyrotechnic extension to the explosive charge.

In the present application, the term "booster" means any priming device that is capable of transmitting a detonation wave, thereby modifying the amplitude per unit area and/or the intensity and/or the shape of that wave.

By way of example, the booster may act to increase the surface area of the detonation wave transmitted to the explosive charge when the diameter of the pyrotechnic extension is less than the critical diameter of the explosive charge (i.e. the diameter below which detonation of the charge cannot take place). The booster then has a shape that flares towards the explosive charge, its maximum diameter being greater than the critical diameter of said charge.

An example of a booster is known from Canadian patent CA 2 066 139. That application describes a munition comprising a low-sensitivity explosive charge, necessitating the interposition of a booster between said explosive charge and the firing device so that firstly the diameter of the wave transmitted to the explosive charge is greater than the critical diameter enabling said charge to be detonated and, secondly, the power of the detonation wave is sufficiently high. In order to increase the diameter of the detonation wave, the booster is provided with an annular wave generator comprising a tapered cap. In order to increase the power of the detonation wave, the booster further comprises a known type of bi-explosive generator.

In a further example, the pyrotechnic transmission unit comprises a first booster coupled to the explosive charge, a second booster coupled to the firing device and a pyrotechnic extension coupling said boosters together.

In an advantageous arrangement of the invention, at least a portion of the pyrotechnic transmission unit is embedded in the inert charge.

In another advantageous arrangement, the explosive charge, the inert charge and the firing device are situated, in that order, one after the other inside the casing of the munition in the axial direction of that casing, the explosive charge being closest to the front of the munition.

In an embodiment of the invention, the interface between the explosive charge and the inert charge extends substantially perpendicularly to the axis of the casing. The explosive charge and the inert charge are thus not superimposed in the radial direction. Preferably, the explosive charge extends substantially over an entire diameter of the casing.

In the present application, two elements are said to be coupled together when detonating one causes detonation of the second.

As indicated above, the firing device and the explosive charge are coupled together by means of a pyrotechnic transmission unit that is coupled to each of them. The couplings between the pyrotechnic transmission unit and the firing device or the explosive charge may optionally be remote.

Thus, in one exemplary embodiment, the pyrotechnic transmission unit and the explosive charge are connected to each other. The pyrotechnic transmission unit and the explosive charge may then be connected to each other via a layer of adhesive. In a variation, the unit can simply rest against a surface of the explosive charge. The unit may also be partially embedded in the charge.

In a further example, the pyrotechnic transmission unit is separated from the explosive charge by a layer of inert material, in particular an inert material forming part of the inert charge. In general, the thickness of this layer needs to be dimensioned so that the detonation issuing from the pyrotechnic transmission unit can propagate by influence to the explosive charge. Advantageously, the layer of inert material is a thin layer, typically 30 millimeters (mm) thick or less.

In another example, the explosive charge and the explosive compound contained in the pyrotechnic transmission unit form a monolithic assembly of homogeneous composition.

Advantageously, the munition comprises at least two pyrotechnic transmission units that are spaced apart from each other. More generally, increasing the number of pyrotechnic transmission units means that transfer of the initial detonation from the firing device can be made more reliable, given that its construction might not be completely axisymmetric.

In an example, the pyrotechnic transmission unit comprises a rigid or flexible, optionally rectilinear tube containing an explosive compound. In particular, the pyrotechnic transmission unit may comprise a flexible detonating cord such as that described in patent application WO 91/04235, for example. The pyrotechnic transmission unit may also comprise a tube containing a granular explosive charge (of the hexogen (RDX) or octogen (HMX) type) or a pressed explosive (of the RDX wax type) or indeed a composite explosive with a cured binder (of the HMX or RDX/polyurethane binder type). The tube may be formed from a plastics material or from metal.

In another example, the pyrotechnic transmission unit comprises a rigid cord of any shape produced from an explosive compound, said cord possibly being bare or covered with a liner. In particular, such a cord constitutes all or a portion of the pyrotechnic extension.

Advantageously, in order to allow efficient transmission of the detonation, the section of the pyrotechnic transmission unit increases at its end connected to the explosive charge. As an example, it is flared towards its end, or it has a tubular end portion of increased section.

The present invention also provides a filler material that is suitable for integration into a munition as defined above, comprising an explosive charge and an inert charge, and further comprising at least one pyrotechnic transmission unit provided with a pyrotechnic extension, said pyrotechnic transmission unit being suitable for transmitting, to said explosive charge, a detonation initiated remotely from the end of the inert charge remote from said explosive charge.

In an advantageous aspect, at least part of the pyrotechnic transmission unit, and in particular said pyrotechnic extension, is embedded in the inert charge.

In an embodiment, the filler material further comprises a sheath adapted to receive the firing device for initiating detonation, the inert charge being interposed between the explosive charge and said sheath.

In another example, the pyrotechnic transmission unit, in particular said pyrotechnic extension, is connected to the explosive charge and/or to said sheath by contact.

In another example, the pyrotechnic transmission unit is coupled to the explosive charge and/or to said sheath via a layer of inert material, in particular an inert material forming part of the inert charge.

The present invention also concerns a method of manufacturing a munition, comprising at least the following steps:

a) providing an elongate hollow casing including an inlet opening at one of its ends;

b) introducing an explosive charge, an inert charge, and at least one pyrotechnic transmission unit provided with a pyrotechnic extension into the casing in a manner such that the pyrotechnic transmission unit is coupled to the explosive charge; and c) coupling the pyrotechnic transmission unit to a firing device;

the inert charge then being interposed between the firing device and said explosive charge, and the pyrotechnic transmission unit enabling said explosive charge to detonate under the action of the firing device.

In an implementation of the method, the explosive charge is introduced into the interior of the casing in a non-solidified state, and it is then solidified therein.

As an example, the explosive charge is introduced into the interior of the casing in the form of an explosive compound paste containing a curable binder and its curing agent. In this example, the explosive compound paste solidifies by said binder curing.

In another example, the explosive charge is introduced into the casing in the form of an explosive compound melt. In this example, the explosive compound solidifies by temperature reduction.

In yet another example, the explosive charge is introduced into the interior of the casing in the form of a monolithic block of appropriate shape.

In an implementational example of the method, the inert charge is introduced into the interior of the casing in a non-solidified state, then it is solidified therein.

In another example, the inert charge is inserted into the interior of the casing in the form of a monolithic block of appropriate shape.

In an implementational example of the method, in step b), the explosive charge is initially introduced into the casing, secondly, the pyrotechnic transmission unit is introduced into the casing and coupled with said explosive charge, and thirdly, the inert charge is introduced into the casing.

In this example, the inert charge is generally introduced into the casing in a non-solidified state, so that it coats the pyrotechnic transmission unit, in particular said pyrotechnic extension.

In an example, the pyrotechnic transmission unit is partially embedded in the explosive charge while it is still in the non-solidified state.

In an example, the pyrotechnic transmission unit is connected to the explosive charge by bonding. It may also simply be in contact with it, without being bonded.

In another implementational example, in step b), firstly, the explosive charge and the inert charge are introduced into the interior of the casing, and then secondly, the pyrotechnic transmission unit is introduced into the casing.

In this example, likewise, the inert charge is generally introduced into the casing as a paste. The pyrotechnic transmission unit is thus immersed in the non-solidified mass of inert material until it comes close to or comes into contact with the explosive charge.

In another implementational example of the method, during step b), an empty tube is introduced into or positioned in the interior of the casing such that its end reaches the volume intended for the explosive charge, an explosive compound is cast as a paste through said tube to filling the volume intended for the explosive charge and the internal volume of the tube, the explosive compound is solidified, then the inert charge is introduced into the casing of the munition.

In an example, the tube is withdrawn after the explosive has solidified. In this example, the rod of explosive molded inside the tube constitutes all or some of the pyrotechnic transmission unit and said rod of explosive in particular forms the pyrotechnic extension.

In another example, the tube is kept inside the casing after solidification, the tube filled with explosive compound constituting all or some of the pyrotechnic transmission unit, and said filled tube in particular forms the pyrotechnic extension.

In another implementational example of the method, the explosive charge and the pyrotechnic transmission unit form a preformed assembly that is introduced into the interior of the casing.

In an example, the explosive charge and the explosive compound contained in the pyrotechnic transmission unit form a monolithic assembly of homogeneous composition.

In an example, after being introduced into the casing and before introducing the inert charge, the pyrotechnic transmission unit is held in position by clamping means.

Various embodiments and implementations are described in the present description. However, unless otherwise indicated, the features described in relation to any one of them may be applied to any of the others.

The invention can be better understood and its advantages are made clearer from the following detailed description of non-limiting exemplary embodiments. The description refers to the accompanying drawings in which.

Figure 1:
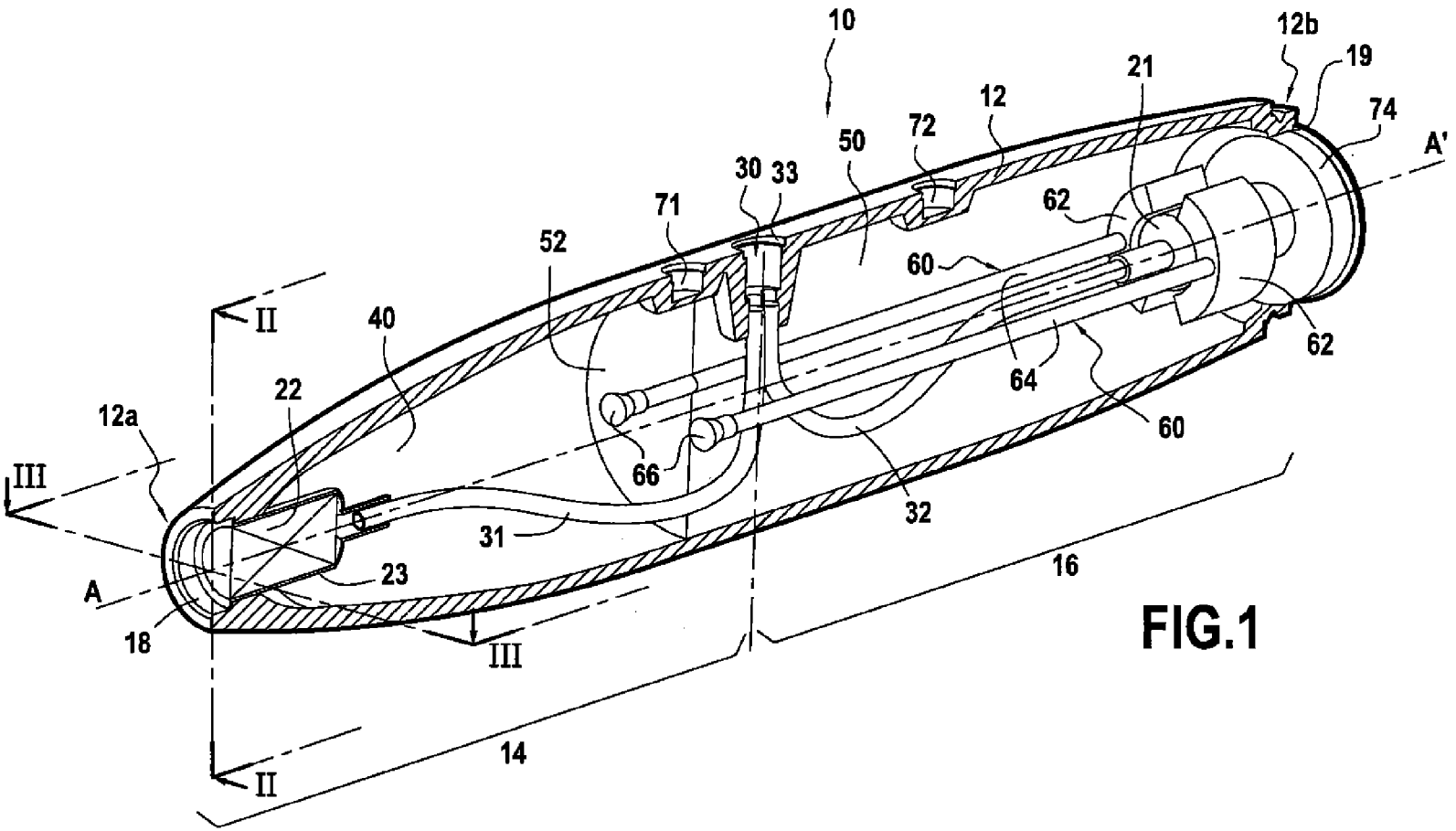
FIG. 1 is a perspective view partially in section of a munition in accordance with a first exemplary embodiment of the present invention.

FIG. 1 shows a munition 10 in accordance with a first exemplary embodiment of the present invention, comprising an elongate casing 12 of axis A-A' formed by a first section 14 or front warhead section, tapered towards its front end 12*a*, and by a second section 16 or rear section, which narrows slightly towards its rear end 12*b*. In a variation, the munition casing 12 may take any other elongate shape.

In the example, the casing 12 has an opening 18 at its front end 12*a* and an opening 19 at its rear end 12*b*.

Throughout the present application, the front of the munition is said to be that end which corresponds to its end facing in its direction of movement (i.e. towards the target) and the rear of the munition corresponds to its opposite end along the axis A-A'.

Figure 2:
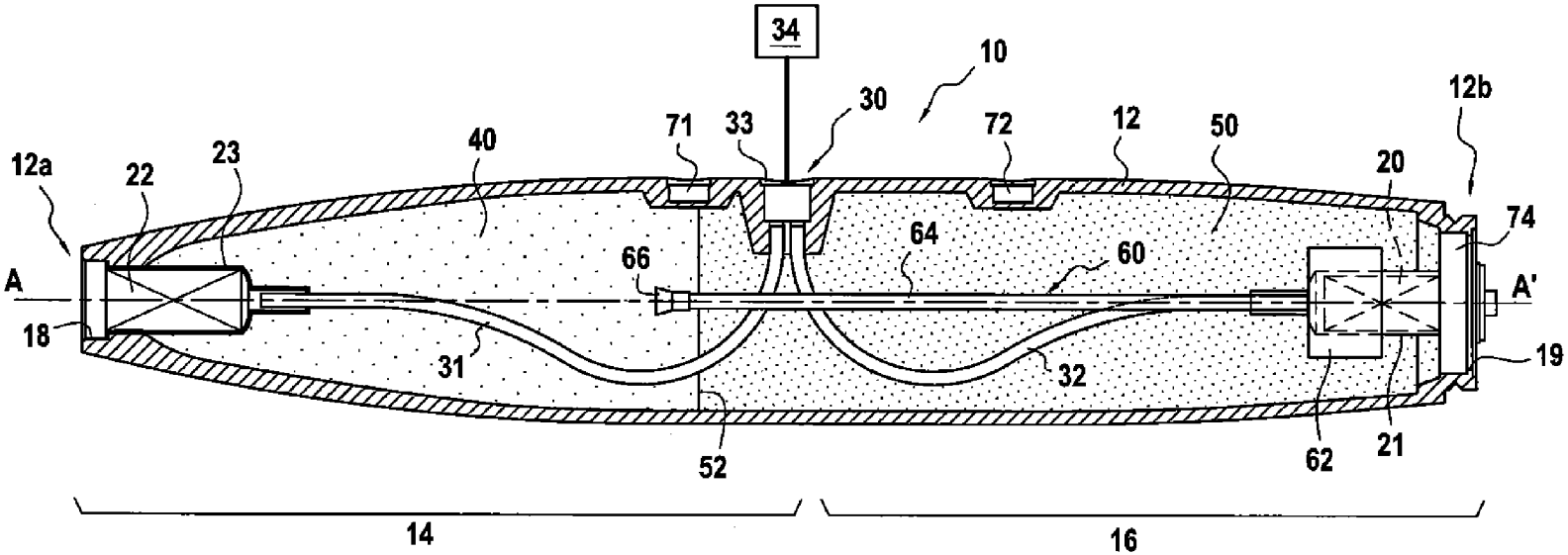
FIG. 2 is a longitudinal sectional view on II-II of FIG. 1 in which, for simplification purposes, only some of the elements are shown in section.

As shown in FIG. 2, a firing device or detonator 20 is located close to the rear end 12*b* of the casing 12. More precisely, in the example shown the firing device 20 is inserted inside a receiving sheath 21 provided at the rear end of the casing 12 (hereinafter the rear sheath).

At its front end 12*a*, the casing 12 houses a functional element 22, in particular ballistic control means such as target-seeking munition guidance means, a proximity detector for triggering the munition in the proximity of the target, or an altimeter. In the example, this functional element 22 is positioned inside a front receiving sheath 23, and closes the above-mentioned opening 18.

The functional element 22 and the firing device 20 are powered by power supply means 34 (shown in FIG. 2) generally located outside the casing 12 of the munition, via electric cables 31, 32. In the example, the electric cables 31, 32 respectively extend from the functional element 22 and the firing device 20 to a power supply zone 30 in this instance located close to the middle of the casing 12 along the axial direction A-A'. The power supply zone 30 includes an opening 33 to the outside of the casing 12 via which the electric cables 31, 32 are connected to the power supply means 34. The power supply means 34 are, for example, a wind turbine, in particular a wind turbine mounted on the casing 12 of the munition, on its outside.

The munition also includes two suspension holes 71, 72 formed in the casing 12, for connection to a delivery platform of an airplane, helicopter, or drone on which the munition is mounted, for example. In the example, the suspension zones 71, 72 are located either side of the power supply zone 30, in the axial direction. The holes 71, 72 are, for example, intended to receive rings for suspending the munition 10 on the delivery platform.

Figure 3:
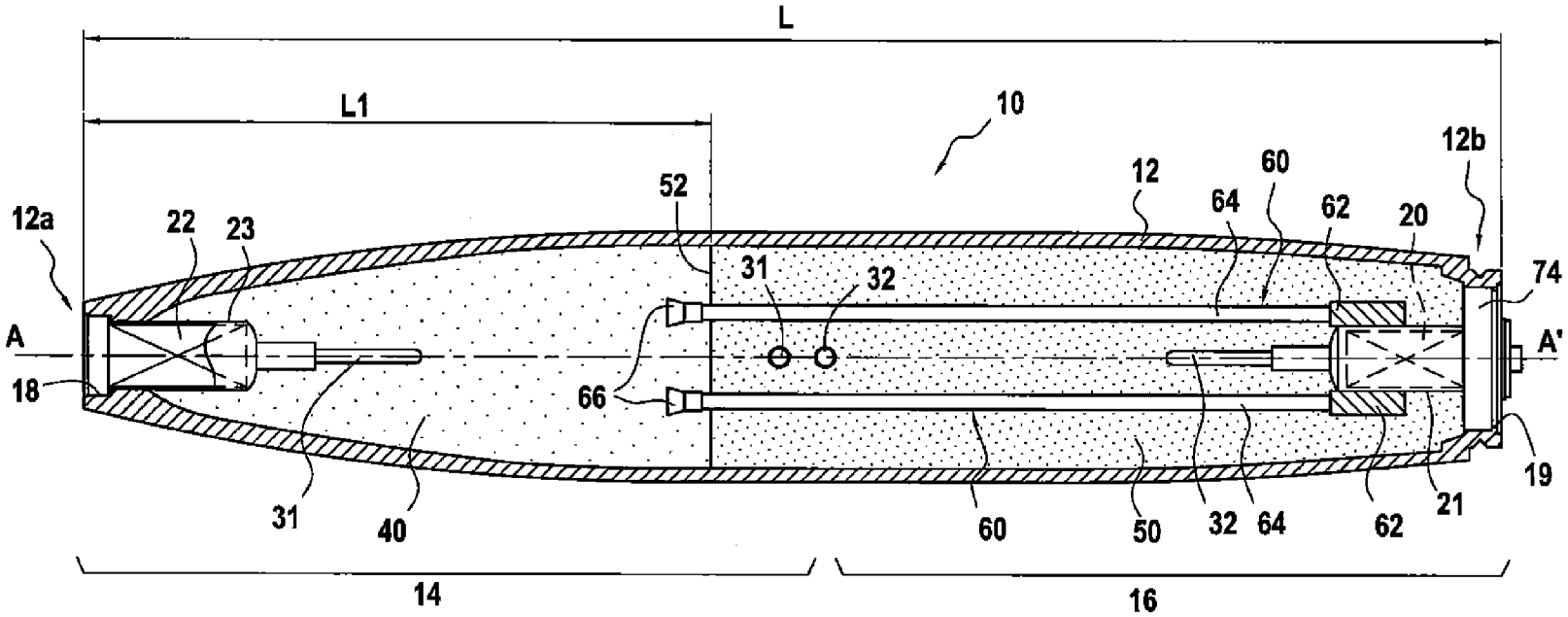
FIG. 3 is a longitudinal sectional view on III-III in FIG. 1 in which, for simplification purposes, only some of the elements are shown in section.

An explosive charge 40 shown in FIGS. 2 and 3 fills the front space of the munition 10, defined by the inner wall of the casing 12 and the front sheath 23, over a length L1 measured from the front end 12*a* of the munition 10. The explosive charge 40 is not in direct contact with the firing device 20 which, as described above, is located at the rear end 12*b* of the casing 12.

In the example shown, the length L1 occupies a little more than one third of the total length L of the munition 10 (see FIG. 3).

The explosive charge 40 may be constituted by a composite, in particular based on aluminum (Al), RDX, and a polyurethane binder. An example of a composition that could be used is the composition referenced PBXN-109. Any other appropriate composition may be suitable, however.

An inert charge 50 of density that is identical or substantially identical to that of the explosive charge 40 is interposed between the explosive charge 40 and the rear sheath 21. The inert charge 50 may be a suitable plastics material, in particular a material with a polyurethane matrix including a mineral filler.

In the example, the explosive charge 40, the inert charge 50, and the firing device 20 are thus located one after the other along the axis A-A', in this order, inside the casing 12 of the munition. In particular, in the example, the interface 52 between the explosive charge 40 and the inert charge 50 shown in FIGS. 1 and 3 extends perpendicularly to the axis A-A'. The rear sheath 21 and thus the firing device 20 are also surrounded by the inert charge 50.

As shown in FIG. 3, the explosive charge 40 is connected to the firing device 20 by pyrotechnic transmission means which in this example comprise two pyrotechnic transmission units 60 passing through the inert charge 50.

In the example, the two transmission units 60 are disposed symmetrically either side of the axis A-A', and each extends parallel to this axis.

Each pyrotechnic transmission unit 60 comprises a first end or front end in the form of a first booster 66 coupled with the explosive charge 40, a second end or rear end in the form of a second booster 62 coupled with the firing device 20 of the munition 10, and a pyrotechnic extension 64 connecting these two ends together.

This pyrotechnic extension 64 is an elongate element: it is thus essentially directed along its main axis, or longitudinal axis, along which its length can be measured and which in the examples shown is parallel to the axis A-A' of the casing 12, and may coincide therewith (in a possibility that is not shown with a single pyrotechnic transmission unit 60, it is coaxial with the casing 12).

The width of the pyrotechnic extension 64 is defined as being its maximum radial dimension, i.e. its largest dimension measured in cross section, i.e. perpendicularly to its main axis.

The first booster 66, the extension 64 and the second booster 62 may, for example, be constituted by an outer sheath formed of metal or plastics, filled with an explosive compound for transmitting the detonation from the firing device 20 to the explosive charge 40.

In the example shown in FIGS. 1 to 3, the second booster 62 is a push-fit around the rear sheath 21 and thus is in direct contact therewith. In particular, the sheath 21 is substantially cylindrical in shape, and the second booster 62 has a complementary shape, in particular formed as a portion of a ring, which allows it to follow the contour of the sheath. In this example, the sheath 21 is sufficiently thin to allow propagation by influence of the detonation from the firing device 20 to the pyrotechnic transmission unit 60.

The function of the second booster 62 here is to increase the surface area of the detonation wave issuing from the firing device in order to guarantee subsequent good transmission.

In another example, in the absence of a rear sheath 21, or if the rear sheath 21 has at least one opening exposing part of the firing device 20 to view, the second booster 62 could also be directly in contact with the firing device 20.

Figure 8:
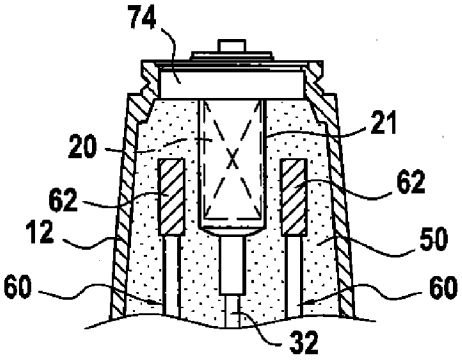

In another example shown in FIG. 8, the pyrotechnic transmission unit 60 could be separated from the sheath 21 or, in the absence of a sheath 21, from the firing device 20, by a layer of inert material, in particular an inert material forming part of the inert charge 50. In this example, the layer of inert material is sufficiently thin for the detonation initiated by the firing device 20 to be capable of propagating by influence to the pyrotechnic transmission unit 60 and thus to the explosive charge 40. Preferably, the thickness of the layer of inert material does not exceed 30 mm.

In the example, the pyrotechnic extension 64 comprises a rigid tube of constant diameter filled with explosive.

In the same example, the first booster 66 has a frusto-conical shape that is flared towards its free end, serving to shape the detonation wave originating from the firing device 20 and transmitted via the pyrotechnic extension 64 to the first booster 66, for example increasing its diameter for more efficient detonation of the explosive charge.

Figure 5:
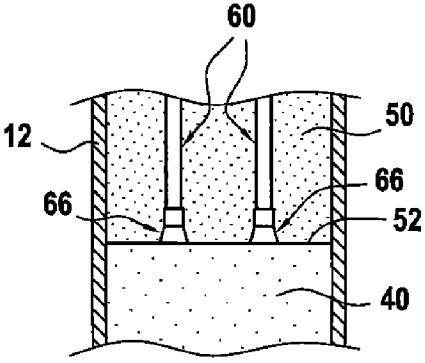

Here, the first booster 66, in particular its flared end, is embedded in the explosive charge 40. In another variation shown in FIG. 5, the first booster 66 may be connected to the explosive charge 40 simply by being rested on the free surface of said explosive charge 40, in particular via its flared end.

Figure 6:
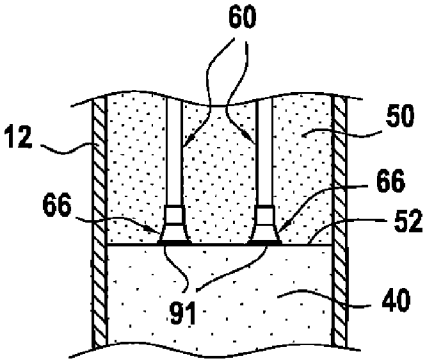

In another variation shown in FIG. 6, the first booster 66 may also be bonded to the explosive charge 40 by a layer of adhesive 91 arranged between the surface of the explosive charge 40 and a surface of the booster 66, in particular its larger end surface in this example.

Figure 7:
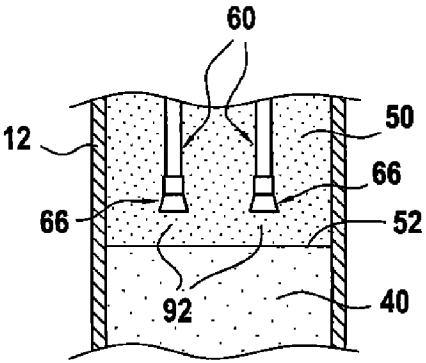
FIGS. 5 to 7 show various coupling variations between a pyrotechnic transmission unit and the explosive charge.

In yet another variation shown in FIG. 7, the or each pyrotechnic transmission unit 60 may be coupled to the explosive charge via a layer of inert material 92 constituting the inert charge 50, said layer 92 being sufficiently thin to allow propagation of the detonation.

It should be noted that the second booster 62, the pyrotechnic extension 64, and the first booster 66 described above could be replaced by any other element allowing transmission of a detonation between the firing device and the explosive charge. The features described above in relation to the pyrotechnic transmission units 60 can be applied to any other pyrotechnic transmission unit of shape or configuration that is different from those described and/or shown, while remaining within the scope of the invention as defined in the claims of the present patent application.

In the example shown, the inert charge 50 embeds, coats, or surrounds all or some of the pyrotechnic transmission units 60 and in particular the pyrotechnic extension 64. It should be noted that in an exemplary embodiment that is not shown, at least one pyrotechnic transmission unit 60 (and its pyrotechnic extension 64) could be around the inert charge 50 and couple the firing device 20 to the explosive charge 40, passing through a space formed between the inert charge 50 and the inner face of the casing 12 of the munition.

Figure 9:
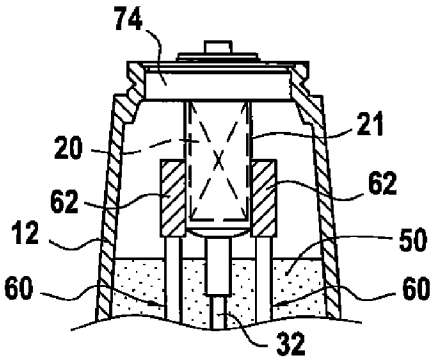
FIGS. 8 and 9 show various coupling variations between a pyrotechnic transmission unit and the firing device.

Furthermore, although in the example shown, the inert charge 50 fills all of the volume situated between the explosive charge 40 and the rear sheath 21 receiving the firing device 20, thereby surrounding a portion of said sheath 21, it is also possible for there to be a free space between the inert charge 50 and the rear of the munition, and more particularly between the inert charge 50 and the rear sheath 21 or the firing device 20. An embodiment of this type is shown in FIG. 9.

An example of an implementation of the method of manufacturing a munition 10 as defined hereinabove is described below in more detail.

Figures 4A, 4B, 4C, 4D, 4E, 4F:
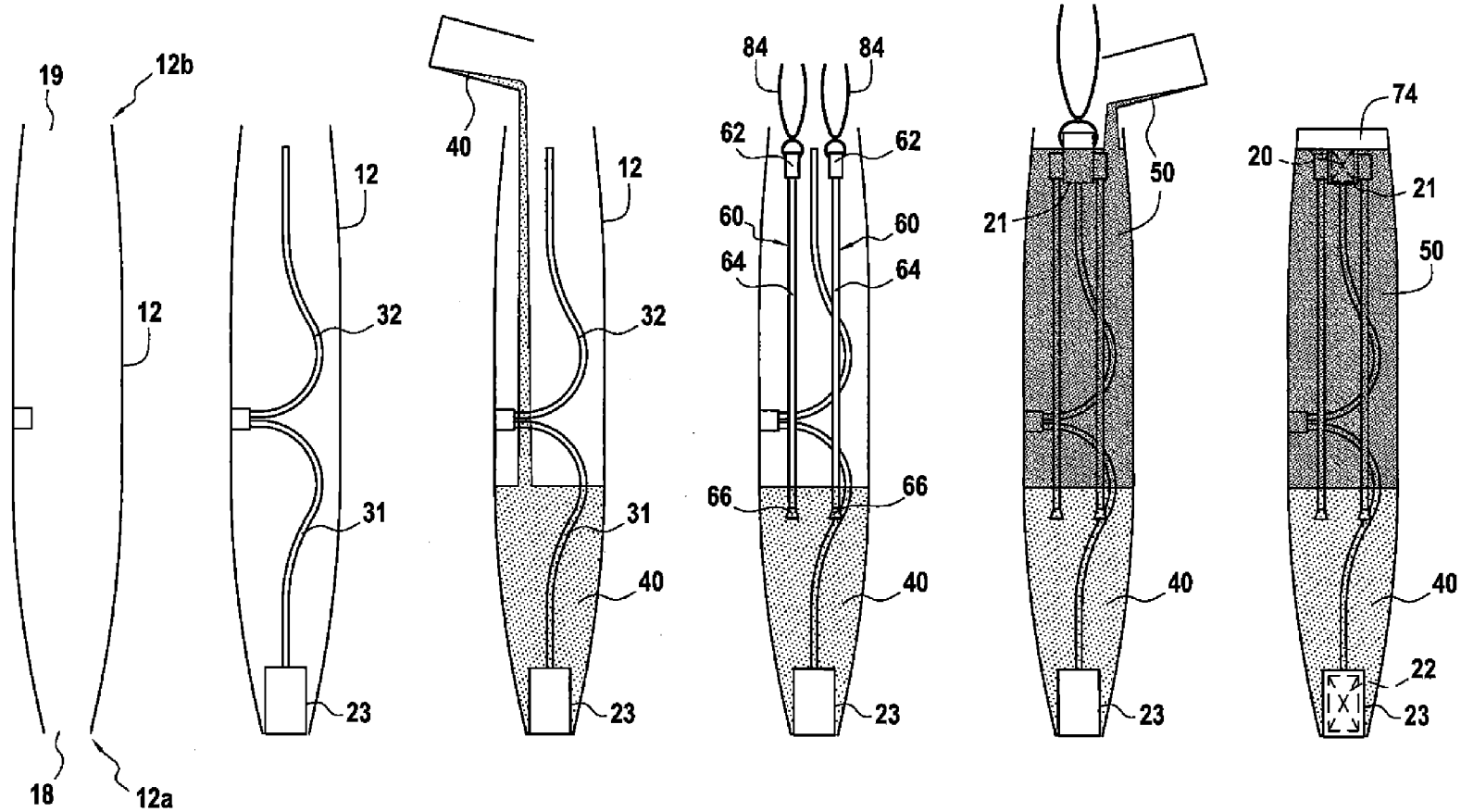
FIGS. 4A to 4F show various successive steps of an implementational example of the method of manufacturing a munition as shown in FIGS. 1 to 3.

In a first step of the method, shown in FIG. 4A, an elongate casing 12 as described above and shown in FIG. 1 is provided. The casing 12 is empty and has an opening 19 in at least its rear end 12*b*. In the example, as indicated above, the casing 12 also has an opening 18 at its front end 12*a*.

In a second step shown in FIG. 4B, the front sheath 23 and the electric cables 31, 32 are introduced into and positioned inside the casing 12.

In the example, the front sheath 23 then obstructs the opening 18 formed at the front end 12*a* of the casing 12.

The first electric cable 31 is connected to the front sheath 23 then to the power supply zone 30. The second cable 32 is connected to the power supply zone 30 via one of its ends. Its other end is free and, because of the rigidity of the cable 32, is held close to the back opening 19.

Optionally, the inner wall of the casing 12 can be coated with a liner prior to this second step.

In a third step of the method, shown in FIG. 4C, an explosive compound paste 40 is cast into the casing 12 via the opening 19. In order to facilitate this step, the casing 12 is preferably placed in the vertical position, with its front end 12*a* directed downwardly. In this manner, the explosive compound 40 fills the front portion of the casing 12, in particular surrounding the front sheath 23 and a portion of the first cable 31.

In a fourth step of the method shown in FIG. 4D, while the explosive compound 40 is still in the form of a paste, the two pyrotechnic transmission units 60 are introduced into the interior of the casing 12 and placed therein so that one end of each of them, in particular the first booster 66 and optionally a section of the pyrotechnic extension 64, is embedded in the explosive compound 40.

In a fifth step of the method, the pyrotechnic transmission units 60 are held in position inside the casing by suitable clamping tools 84.

In a sixth step of the method, the casing 12, including the explosive compound paste 40, is conditioned to ensure solidification of said compound 40 and to obtain a solid explosive charge adhering to the inner wall of the casing 12. When the explosive compound 40 contains a curable binder and its curing agent, solidification occurs by curing of the binder. In a variation, when the explosive compound 40 is molten, solidification is obtained by reducing its temperature.

Solidification of the explosive compound traps the end (the first booster 66 and possibly a section of the pyrotechnic extension 64) of each pyrotechnic transmission unit 60 in the mass of the explosive charge 40.

At this stage, the clamping tools for the pyrotechnic transmission unit 60 can be removed or left in place if they can be dismantled during the subsequent steps of the method.

In a seventh step of the method shown in FIG. 4E, firstly, the rear sheath 21 is positioned in the desired location, then an inert material 50 is introduced into the remaining free internal volume of the casing 12 of the munition, so that it comes into contact with the free surface of the explosive charge 40, trapping the pyrotechnic transmission units 60 and surrounding the rear sheath 21.

The inert material 50 is cast in the form of a paste then solidified, for example by curing, in the free internal volume of the casing 12.

The method is continued in an eighth step shown in FIG. 4F, which can in particular be carried out during subsequent use of the munition. A firing device 20 is fixed inside the rear sheath 21 and a functional device 22 of the ballistic control means type is housed in the front sheath 23. The functional device 22 is then connected up to the first cable 31 and the firing device 20 is connected up to the second cable 32.

Finally, the opening 19 situated at the rear end 12*b* of the bomb casing 12 is closed using a screw 74.

However, the implementational example described above is not limiting. The following variations in particular could be envisaged.

In a first implementational variation, the explosive compound paste 40 could be solidified before introducing the pyrotechnic transmission unit or units 60 into the casing 12 of the munition 10.

In a second implementational variation, the explosive charge 40 may be in the form of a preformed block capable of being introduced into the interior of the casing 12 of the munition and of cooperating with its internal walls by virtue of having a matching shape.

In both variations in question, each transmission unit 60 may be bonded, in particular via its end (the first booster 66, or in the absence thereof, the pyrotechnic extension 64) to the free surface of said explosive charge 40.

The pyrotechnic transmission units 60 may also simply be in contact with the explosive charge 40 or positioned at a short distance from it. The inert charge 50 may then be introduced before the pyrotechnic transmission units 60, in particular if it is introduced into the casing 12 in an as yet non-solidified state. Thus, in one exemplary embodiment, the explosive charge is first put in position and solidified, then the inert charge is cast in paste form and the pyrotechnic transmission unit 60 is introduced so that its end beside the explosive charge 40 (the first booster 66 or, in its absence, the pyrotechnic extension 64) comes into contact with the explosive charge 40 or such that this end is placed close to said explosive charge 40, it being separated by a thin layer of inert material, in particular of 30 mm or less.

In accordance with a third variation of the method, at least one empty tube is positioned longitudinally in the empty casing of the munition, one of its ends being immersed in the casing 12 to a set level for the explosive material 40, the other end being located in the back portion for connection with the firing device 20. An explosive compound paste 40 is then cast via said tube to fill a volume in the front zone of the munition (set volume for the explosive charge) and the internal volume of the tube. In this example, it should be understood that the viscosity of the paste must be sufficiently low to allow the paste to flow in the tube, said tube forming at least a section of the pyrotechnic extension 64 and possibly of the first booster 66.

The casing 12 of the munition is then conditioned to harden the explosive material paste 40. After solidification, the tube is either left in position or withdrawn. Thus, a monolithic block is obtained that is constituted by explosive charge 40 in the front portion of the munition 10 extended by a rod of explosive, which may be contained in the tube if it is left in position, constituting all or a portion of the pyrotechnic transmission unit 60. The subsequent steps are identical to those described above in relation to the first implementational example of the method.

In a fourth variation of the method, when the architecture of the munition casing 12 allows it, the explosive charge 40 and the pyrotechnic transmission unit or units 60 constitute a preformed assembly (for example obtained by shaping in a mold). This assembly is introduced into and bonded in the casing 12 and cooperates with the inner surface of the front portion of the munition casing 12 by matching its shape. The subsequent steps are identical to those described above in relation to the first implementational example of the method.

The invention claimed is:

1. A munition comprising:

an elongate casing extending along an axis that defines an axial direction of the elongated casing, the elongated casing housing an explosive charge in a single compartment, and a single inert charge in the single compartment, the explosive charge having a substantially identical density as the inert charge;

a firing device, wherein at least a portion of the inert charge is interposed between the firing device and the explosive charge; and at least one pyrotechnic transmission unit provided with a pyrotechnic extension, the pyrotechnic transmission unit coupling the firing device to the explosive charge to allow the explosive charge to be detonated by the action of the firing device, wherein the explosive charge, the inert charge and the firing device are situated inside the elongate casing in the axial direction of the elongate casing consecutively in this order, the explosive charge being closer to a front of the munition than the inert charge and the firing device.

2. The munition according to claim 1, wherein the firing device is positioned at a rear end of the munition, and the explosive charge is positioned at a front end of the munition.

3. The munition according to claim 1, wherein the pyrotechnic transmission unit is at least partially embedded in the inert charge.

4. The munition according to claim 1, comprising at least two pyrotechnic transmission units spaced apart from each other.

5. The munition according to claim 1, wherein the pyrotechnic extension is formed by a rigid or flexible tube containing an explosive compound.

6. The munition according to claim 1, wherein the pyrotechnic extension is formed by a rigid cord of any shape, produced from an explosive compound.

7. The munition according to claim 1, wherein the pyrotechnic extension has a maximum radial dimension that is at least 5 times smaller than a maximum diameter of the munition.

8. The munition according to claim 1, wherein the pyrotechnic extension is at least 10 times longer than it is wide.

9. The munition according to claim 1, wherein the length of the pyrotechnic extension is at least half the total length of the munition.

10. The munition according to claim 1, wherein the pyrotechnic transmission unit further comprises a first booster coupling the pyrotechnic extension to the explosive charge.

11. The munition according to claim 10, wherein the first booster is separated from the explosive charge by a layer of inert material, in particular a layer of inert material forming part of the inert charge.

12. The munition according to claim 1, wherein the pyrotechnic extension comprises a single explosive compound of homogeneous composition.

13. The munition according to claim 1, wherein the pyrotechnic extension has a maximum radial dimension that is at least 20 times smaller than a maximum diameter of the munition.

14. The munition according to claim 1, wherein the pyrotechnic extension is at least 20 times longer than it is wide.

15. A method of manufacturing a munition according to claim 1, comprising at least the following steps:

a) providing an elongate hollow casing extending along an axis that defines an axial direction of the elongate hollow casing, the elongate hollow casing including at least one inlet opening at one end of the elongate hollow casing;

b) introducing an explosive charge into a single compartment of the elongate hollow casing, a single inert charge into the single compartment of the elongate hollow casing, and at least one pyrotechnic transmission unit provided with a pyrotechnic extension into the elongate hollow casing in a manner such that the pyrotechnic transmission unit is coupled to the explosive charge, the explosive charge having a substantially identical density as the inert charge; and c) coupling the pyrotechnic transmission unit to a firing device, wherein the inert charge is interposed between the firing device and the explosive charge, and the pyrotechnic transmission unit enables the explosive charge to detonate under the action of the firing device; and the explosive charge, the inert charge and the firing device are situated inside the elongate hollow casing in the axial direction of the elongate hollow casing consecutively in this order, the explosive charge being closer to a front of the munition than the inert charge and the firing device.

16. The manufacturing method according to claim 15, wherein the explosive charge is introduced into the interior of the elongate hollow casing in the form of a monolithic block of appropriate shape.

17. The manufacturing method according to claim 15, wherein the explosive charge is introduced into the interior of the elongate hollow casing in a non-solidified state, then the explosive charge is solidified therein.

18. The manufacturing method according to claim 15 wherein, during step b):

an empty tube is introduced into and positioned inside the elongate hollow casing so that an end of the tube is at the level of a volume envisaged for the explosive charge;

an explosive compound is cast in paste form via the tube until the volume envisaged for the explosive charge and the internal volume of the tube are filled;

the explosive compound is solidified; and then the inert charge is introduced into the elongate hollow casing of the munition.

19. The manufacturing method according to claim 15, wherein the explosive charge and the pyrotechnic transmission unit form a preformed assembly that is introduced into the interior of the elongate hollow casing.

20. The manufacturing method according to claim 15, wherein the inert charge is introduced into the interior of the elongate hollow casing in the form of a paste, then the inert charge is solidified therein.

21. The manufacturing method according to claim 15, wherein the inert charge is inserted into the interior of the elongate hollow casing in the form of a monolithic block of appropriate shape.

* * * * *